US006633739B2

(12) United States Patent
White et al.

(10) Patent No.: US 6,633,739 B2
(45) Date of Patent: Oct. 14, 2003

(54) DETONING BLADE

(75) Inventors: Frederick B. White, Farmington, NY (US); Alicia G. Hughes, Penfield, NY (US); Michael J. DeLuzio, Rochester, NY (US); Ann M. Kazakos, Webster, NY (US)

(73) Assignee: Xerox Corporation, Stamford, CT (US)

( * ) Notice: Subject to any disclaimer, the term of this patent is extended or adjusted under 35 U.S.C. 154(b) by 52 days.

(21) Appl. No.: 10/015,889

(22) Filed: Dec. 17, 2001

(65) Prior Publication Data

US 2003/0113146 A1 Jun. 19, 2003

(51) Int. Cl.[7] ..... G03G 21/00

(52) U.S. Cl. ..... 399/353; 399/350; 428/684; 428/685

(58) Field of Search ..... 399/350, 351, 399/353, 354, 355, 273, 274, 283, 284; 428/213–217, 220, 544, 615, 681–685; 15/236.01

(56) References Cited

U.S. PATENT DOCUMENTS

| | | | | | |
|---|---|---|---|---|---|
| 3,572,923 | A | | 3/1971 | Fisher et al. | |
| 4,337,300 | A | * | 6/1982 | Itaba et al. | 428/627 |
| 4,633,999 | A | * | 1/1987 | Perneczky | 198/499 |
| 4,653,373 | A | * | 3/1987 | Gerber | 83/697 |
| 5,085,171 | A | * | 2/1992 | Aulick et al. | 399/284 |
| 5,120,596 | A | * | 6/1992 | Yamada | 428/216 |
| 5,209,997 | A | | 5/1993 | Fromm et al. | 430/99 |
| 5,243,385 | A | | 9/1993 | Thayer | |
| 5,512,995 | A | | 4/1996 | Gerbasi | |
| 5,652,045 | A | * | 7/1997 | Nakamura et al. | 428/216 |
| 5,732,320 | A | | 3/1998 | Domagall et al. | 399/350 |
| 5,863,329 | A | * | 1/1999 | Yamanouchi | 118/100 |
| 6,088,564 | A | | 7/2000 | Imes et al. | 399/284 |
| 6,134,405 | A | | 10/2000 | Zona | 399/148 |
| 6,263,180 | B1 | | 7/2001 | VanLaeken et al. | 399/284 |
| 6,282,401 | B1 | | 8/2001 | Proulx et al. | 399/350 |

FOREIGN PATENT DOCUMENTS

| | | | |
|---|---|---|---|
| EP | 1092535 A | * | 4/2001 |
| EP | 1205271 A | * | 5/2002 |

* cited by examiner

*Primary Examiner*—Robert Beatty
(74) *Attorney, Agent, or Firm*—Andrew D. Ryan

(57) ABSTRACT

A detoning blade including a steel member of stainless steel or carbon steel having a length, a width, and a thickness and a coating including titanium nitride or tungsten carbide having a thickness ranging from 0.1 microns to 4 microns or a coating of diamond embedded chromium having a thickness ranging from 2.5 microns to 7.5 microns.

22 Claims, 4 Drawing Sheets

DETONING BLADE

BACKGROUND OF THE INVENTION

This invention relates generally to a cleaning apparatus in a printing or copying apparatus, and more particularly to a detoning blade for cleaning a roller therein.

While existing detoning blades are generally suitable, improvements in development quality and wear are desired. Therefore, a cost-effective detoning blade providing improved wear resistance is beneficial.

Examples of cleaning systems, detoning systems and blades can be found in U.S. Pat. Nos. 3,572,923; 5,209,997; 5,243,385; 5,512,995; 5,732,320; 6,088,564; 6,134,405; 6,263,180; and 6,282,401.

All documents cited herein, including the foregoing, are incorporated herein in their entireties for all purposes.

SUMMARY OF THE INVENTION

In embodiments, a detoning blade is provided, comprising a steel member having a length, a width, and a thickness. A coating comprising titanium nitride is disposed on at least a portion of the steel member. The coating has a thickness ranging from 0.1 micron to 4 microns. The steel may be a carbon steel including grade 1095 or a stainless steel including grades 301 and 302. The surface hardness of the detoning blade may be up to 80 Rockwell C.

In embodiments, a detoning blade is provided, comprising a steel member having a length, a width, and a thickness. A coating comprising tungsten carbide is disposed on at least a portion of the steel member. The coating has a thickness ranging from 0.1 micron to 4 microns. The steel may be a carbon steel including grade 1095 or a stainless steel including grades 301 and 302. The surface hardness of the detoning blade may be up to 68 Rockwell C.

In embodiments, a detoning blade is provided, comprising a steel member having a length, a width, and a thickness. A coating comprising diamond embedded chromium is disposed on at least a portion of the steel member. The coating has a thickness ranging from 2.5 micron to 7.5 microns. The steel may be a carbon steel including grade 1095 or a stainless steel including grades 301 and 302.

In embodiments, a method of making a detoning blade is provided, comprising: providing a steel member having a length up to 40 mm and a thickness up to about 100 microns; and applying a coating of titanium nitride or tungsten carbide having a thickness ranging from 0.1 micron to 4 microns on at least a portion of a surface of the steel member using physical vapor deposition or chemical vapor deposition at a temperature ranging from 70 degrees F. to 450 degree F. Alternatively, the coating may include diamond embedded chromium (Armoloy XADC) having a thickness ranging from 2.5 microns to 7.5 microns using an Armoloy coating process at a temperature ranging from 70 degrees F. to 200 degree F. The method may include providing a carbon steel including grade 1095 or a stainless steel including grades 301 and 302.

In embodiments, an apparatus for removing particles from a surface of a roller is provided, comprising a housing, a roller, a detoning blade, and a detoning blade holder. The housing includes an open ended chamber. The roller is rotatably mounted in the housing. The detoning blade has a length, a width, a thickness, a free end and a fixed end. The free end contacts the roller. The detoning blade includes a steel and a coating of titanium nitride or tungsten carbide having a thickness ranging from 0.1 microns to 4 microns disposed on at least a portion of the steel. Alternatively, the coating may include diamond embedded chromium (Armoloy XADC) having a thickness ranging from 2.5 microns to 7.5 microns. The detoning blade holder is coupled to the housing on one end and coupled to the fixed end of the detoning blade on another end of the detoning blade holder with the free end of the detoning blade contacting the roller. The detoning blade may include a beveled edge or a square edge in contact with the roller. The steel may include a carbon steel such as a grade 1095 and a stainless steel such as grades 301 and 302.

In embodiments, a method for removing particles from a surface of a roller is provided, comprising: providing a roller having a surface; providing a detoning blade having a length, a width, a thickness, and a free end in contact with the roller, the detoning blade comprising a steel and a coating having a thickness ranging from 0.1 micron to 7.5 microns disposed on at least a portion of the member, the coating including titanium nitride, tungsten carbide, or diamond embedded chromium; supporting the detoning blade in a detoning blade holder; applying a force on the roller using the free end of the detoning blade; and rotating the roller and scraping toner from the surface. The method may include providing a carbon steel including grade 1095 or a stainless steel including grades 301 and 302. The method may include providing a beveled edge or a square edge at the free end of the detoning blade having a beveled edge in contact with the roller.

Still other aspects and advantages of the present invention and methods of construction of the same will become readily apparent to those skilled in the art from the following detailed description, wherein only the preferred embodiments are shown and described, simply by way of illustration of the best mode contemplated of carrying out the invention. As will be realized, the invention is capable of other and different embodiments and methods of construction, and its several details are capable of modification in various obvious respects, all without departing from the invention. Accordingly, the drawing and description are to be regarded as illustrative in nature, and not as restrictive.

DETAILED DESCRIPTION OF THE INVENTION

While the principles and embodiments of the present invention will be described in connection with a detoning blade, electrostatographic apparatus, electrophotographic apparatus, xerographic apparatus, printing and/or copying machine, it should be understood that the present invention is not limited to that embodiment or to that application. The invention is also suitable for use as a cleaning blade, detoning blade or any other blade-type component in a printing or copying apparatus. Therefore, it should be understood that the principles of the present invention and embodiments extend to all alternatives, modifications, and equivalents thereof.

Figure 1:
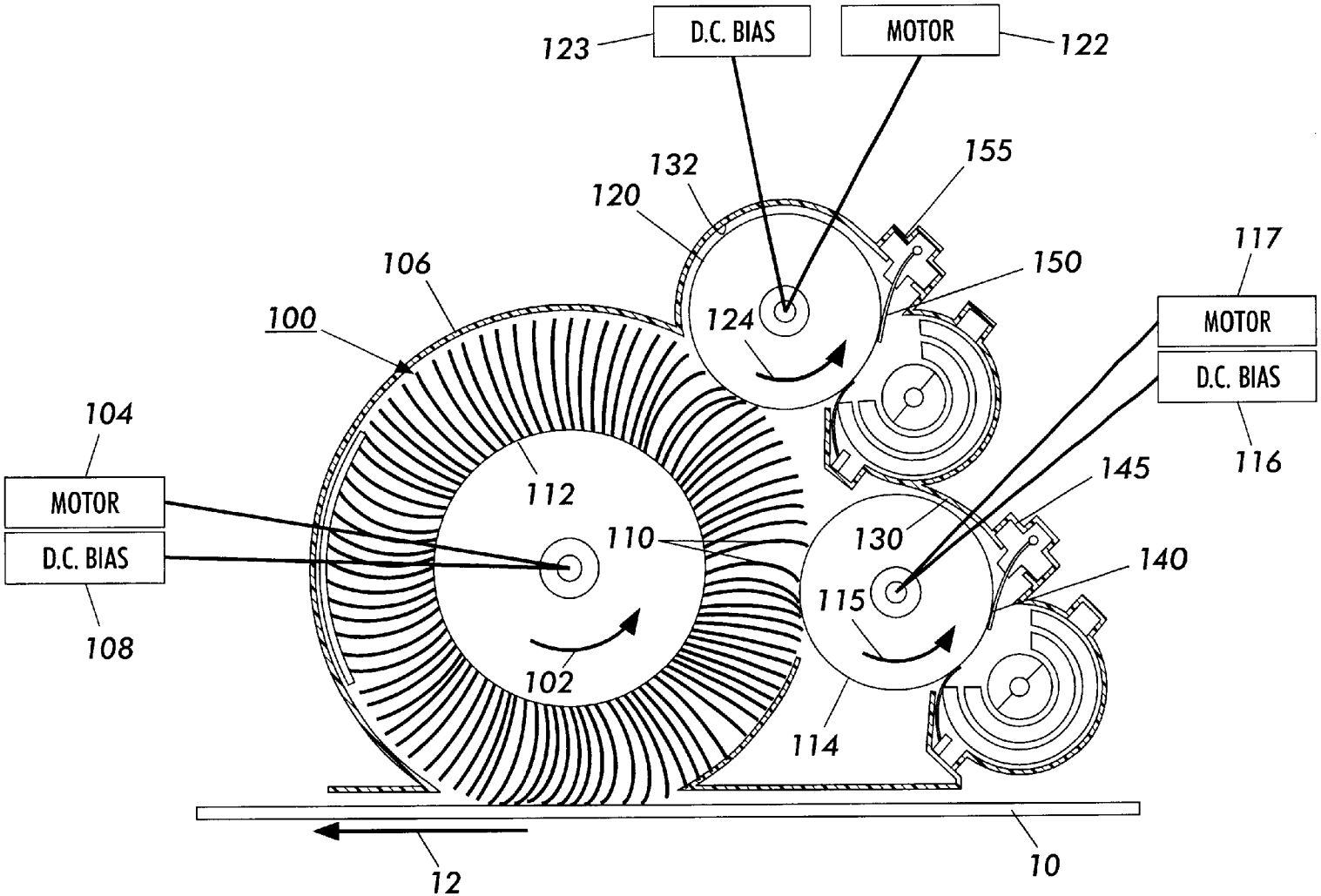
FIG. 1 is an elevational view of a cleaning apparatus for an electrophotographic printing machine.

Turning to FIG. 1, illustrated is an embodiment of the cleaning apparatus for an electrophotographic printer is shown. The apparatus includes a fiber brush cleaning arrangement having dual detoning rollers for removing residual toner and debris from the image carrier 10. (Although the embodiment described uses two detoning rollers on a brush, the present invention will also work with one detoning roller on a brush or with one or more detoning rollers on other cleaning members such as conductive foam or magnetic brush rollers). A fiber cleaning brush 100 is supported for rotational movement in the direction of the arrow 102 via motor 104, within a cleaning housing 106, and biased to clean the preferred polarity toner by means of a D.C. power source 108. (The cleaning brush in FIG. 1 is shown as being biased, however, the present invention is also applicable to a mechanical cleaner brush.) A fiber brush may advantageously comprise a large number of conductive cleaning fibers 110 supported on a conductive cylindrical member 112. The housing 106 may be economically manufactured in a unitary extrusion, with recesses formed in accordance with component requirements. Residual toner and contaminants or debris such as paper fibers and Kaolin are removed from the photoreceptor belt 10 surface by means of a brushing action of the fibers 110 against belt 10 and the electrostatic charge applied to the fibers from the D.C. power supply 108.

The biased detoning rollers are located in adjacent proximity to the biased brush 100 to enable the detoning rollers 114, 120 to electrostatically remove the toner particles from the brush fibers 110. The brush fibers 110 containing toner and debris removed from image carrier 10, rotating in the direction of arrow 12, are first contacted by a first detoning roller 114 supported for rotation in the direction of arrow 115, the same direction as brush 100, by means of a motor 117. An electrical bias is supplied to first detoning roller 114 from D.C. power supply 116. The detoning roller 114 is supported in a rotational position against brush 100, closely spaced to the position where brush fibers 110 leave contact with the surface of image carrier such as photoreceptor belt 10. A second detoning roller 120 is provided for further removal of the preponderance of residual toner from the brush at a location spaced along the circumference of the brush 100. A motor 122 drives the detoning roller 120 in the direction of the arrow 124, the same direction as fiber brush 100 and roller 114. An electrical bias is supplied to the detoning roller 120 from a D.C. power source 123. Recesses 130 and 132 in cleaning housing 106 are provided for the support of the detoning rollers 114 and 120, respectively therein. Within these recesses, and removed from cleaning brush 100, are located detoning blades 140, 150 for the detoning rollers 114, 120, respectively. The detoning blades 140, 150 remove the toner and debris particles from the surface of the detoning rolls 114,120 by a chiseling or scraping action when the blades 140, 150 are in the doctoring mode, as shown in FIG. 1. (The detoning blades can also remove the toner and debris particles from the detoning rollers by a wiping action, if the detoning blades are in the wiper mode.) The detoning blade is a metal material which may include stainless steel, aluminum, phospher bronze, beryllium-copper, and carbon steel. The removed toner and debris particles fall into the auger arrangements and are transported to a storage area or to a developing station.

Figure 2:
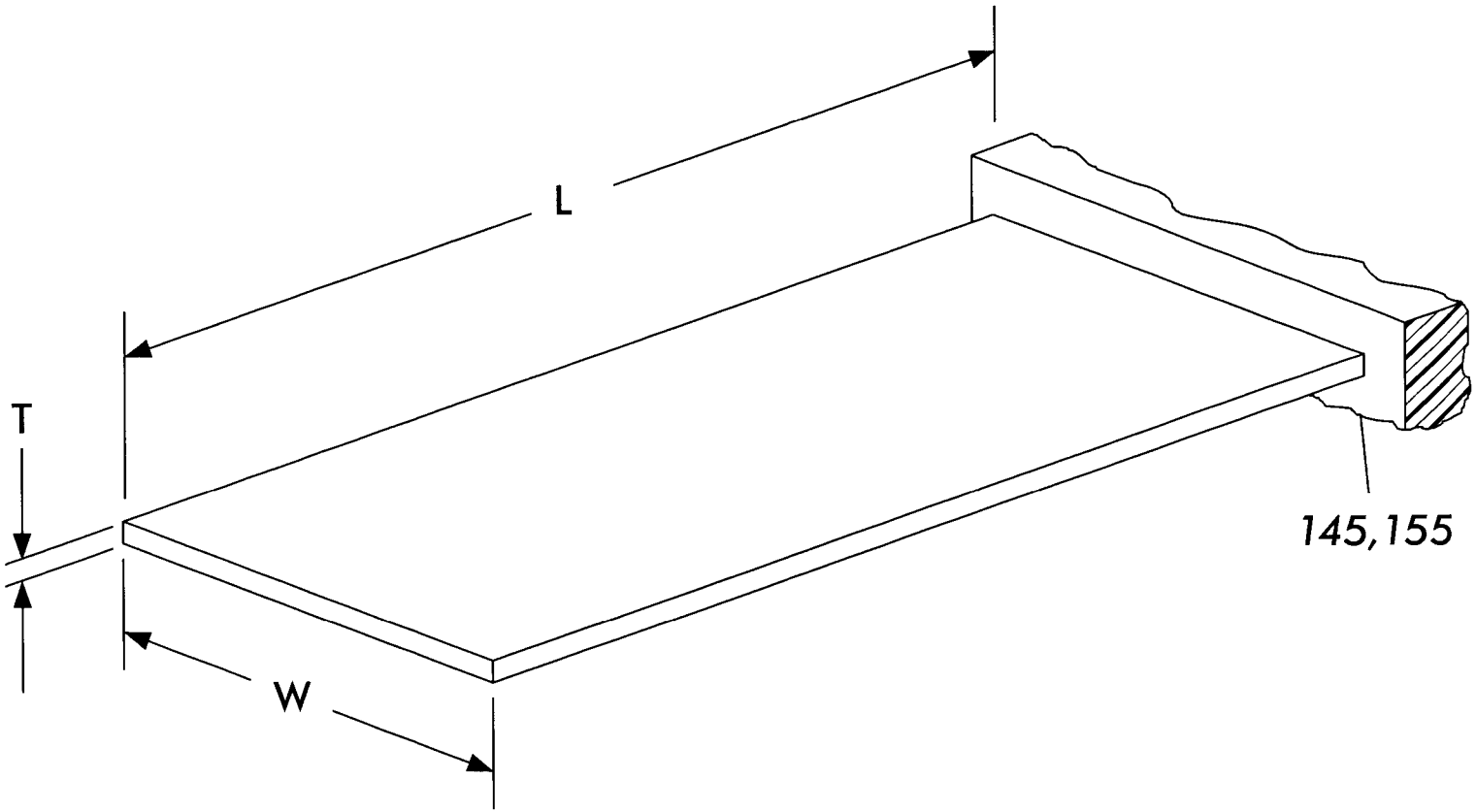
FIG. 2 is a schematic of a detoning blade extending from a blade holder.

Reference is now made to FIG. 2, which depicts a detoning blade, used to clean the detoning rollers 114, 124. The extension length (L), is the length of the detoning blade extending from the blade holder 145, 155 to the free end of the detoning blade. The length (L) ranges from 3 mm to 40 mm. The thickness (T) is the thickness of the blade including coating and ranges from 0.04 mm to 0.1 mm, generally about 0.06–0.08 mm. The width (W) is the width of the blade and ranges from about 420 mm for "long edge feed" and 240 mm for "short edge feed" (A "short edge feed" is when 8½ in.×14 in. paper is fed into the copier by it's 8½ in. edge where the typical process width is 9 in. to avoid edge effects. A "long edge feed" is where the paper is fed in by it's 14 in. edge.) The blade holder is approximately 430 mm for long edge feed and 250 mm for short edge feed.

Figure 3:
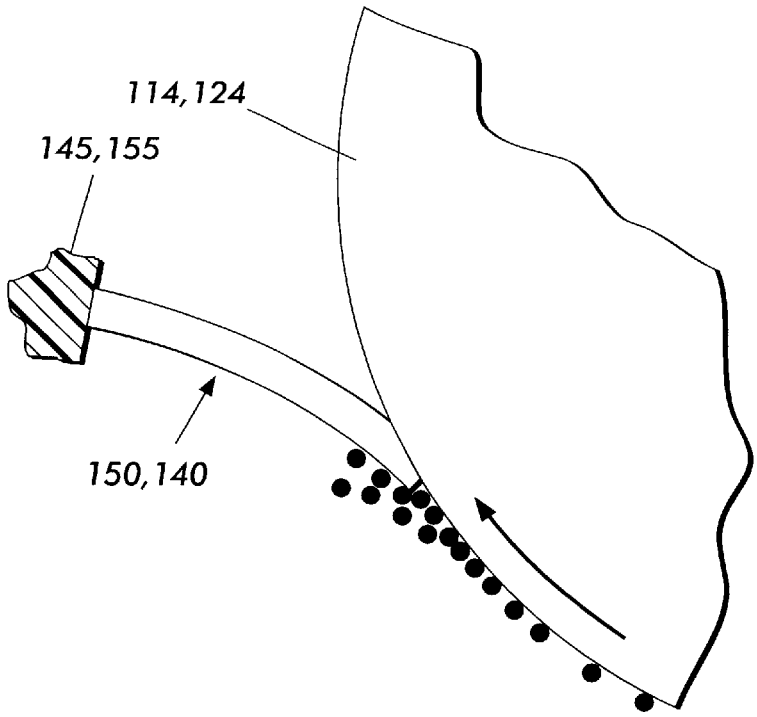
FIG. 3 is a schematic of an embodiment of the detoning blade contacting a roller.

FIG. 3 illustrates the free end of the blade frictionally contacting the detoning roller to clean particles or toner from the surface of the detoning roller.

Figure 4:
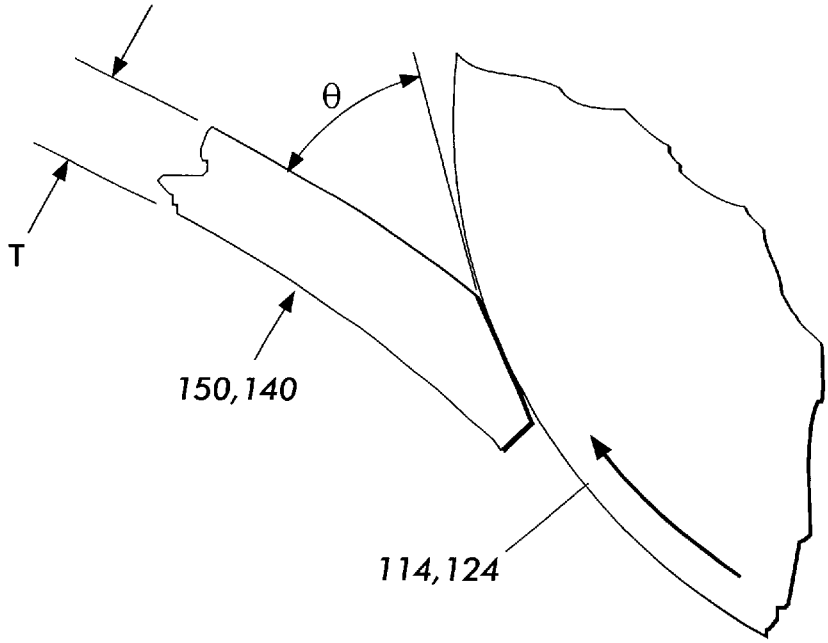
FIG. 4 is a schematic of another embodiment of the detoning blade including a beveled edge contacting a roller.

FIG. 4 illustrates an embodiment of a detoning blade with a beveled free end frictionally contacting the roller. The beveled edge may be ground to a desired angle θ ranging from 30 degrees to 45 degrees, generally about 30 degrees. In embodiments, the beveling of the blade provides a wear surface and the coating provides a generally hard, low friction surface and finish.

Figure 5:
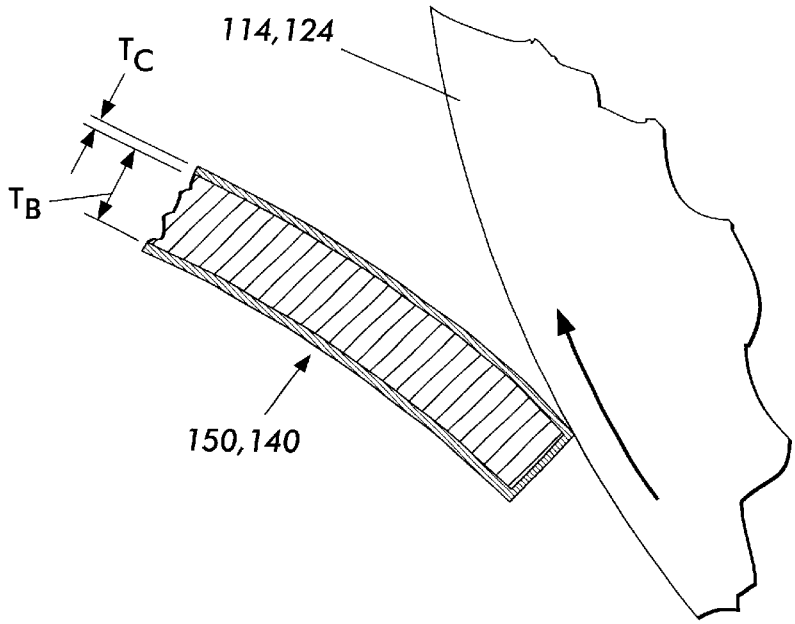
FIG. 5 is a schematic of yet another embodiment of the detoning blade including a square edge and coating contacting a roller.

FIG. 5 illustrates an embodiment of a blade having a coated surface and a free end with a square edge for contact with the detoning roller.

Figure 6:
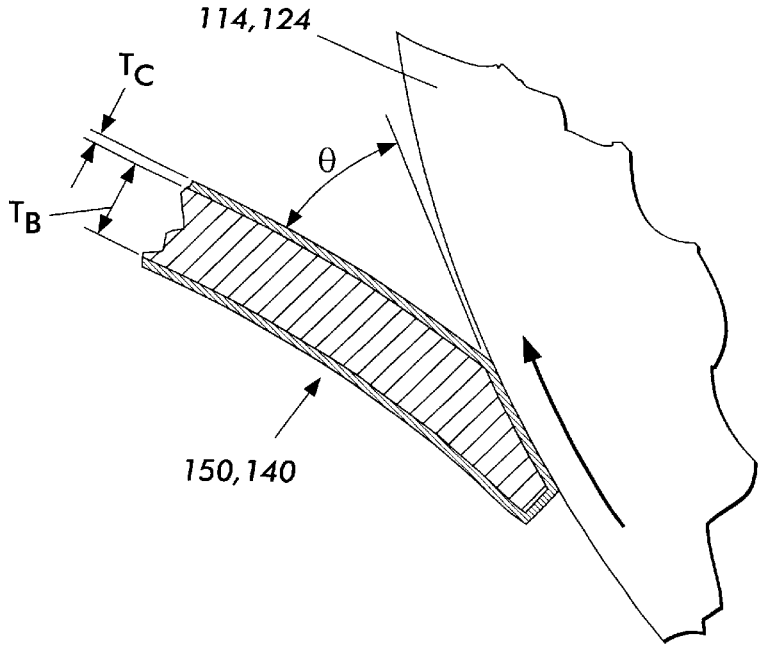
FIG. 6 is a schematic of a further embodiment of the detoning blade including a beveled edge and a coating contacting a roller.

FIG. 6 illustrates an embodiment of a blade having a coated surface and a free end with a beveled edge for contact with the detoning roller.

In embodiments, the coatings of titanium nitride and tungsten carbide are commercially available from Balzers Tool Coating Inc., Amherst N.Y. The diamond embedded chromium coating (Armoloy XADC) is commercially available from Armoloy of Illinois, DeKalb, Ill., 60115. The thickness ($T_B$) is the thickness of the blade without coatings and ranges from 0.035 mm to 0.095 mm, generally about 0.055 mm. The thickness ($T_C$) of titanium nitride and tungsten carbide coatings ranges from 0.1 micron to 4 microns, generally about 2 microns. The thickness ($T_C$) of diamond embedded chromium coating ranges from 2.5 microns to 7.5 microns, generally about 4–5 microns. The titanium nitride and tungsten carbide coatings are disposed on the blade using a temperature of (70 degrees F. to 450 degrees F.) physical vapor deposition (PVD) process or chemical vapor deposition (CVD) process, a substrate temperature (70 degrees F. to 450 degrees F.) and a deposition pressure ranging from 0.05 torr to about 0.15 torr, generally about 0.05 torr. The Armoloy XADC coating is disposed on the blade using a temperature (70 degrees F. to 200 degrees F.) Armoloy coating process. The low temperature PVD or CVD process of coating advantageously protects the blade against wear, abrasion and friction without deformation. The deposition of a hard thin-film coating advantageously extends the service life of the detoning blade providing an immediate benefit to users. The principal consideration for wear of blades is mechanical wear for stainless steel and mechanical wear and corrosion (rust) for carbon steel blades.

A coating of Titanium Nitride on the blade having a thickness of 0.1–4 microns increases surface hardness of the blade to about 80 Rockwell C. A coating of Tungsten Carbide having a thickness of 0.1–4 microns increases surface hardness of the blade to about 68 Rockwell C. A coating of diamond embedded chromium having a thickness of 2.5–7.5 microns increases surface hardness of the blade to about 90 Rockwell C. Grinding and forming a beveled edge and subsequent coating of a wear surface on a steel blade may increase the service life of detoning blades against highly abrasive rollers such as ceramic detoning rollers. The increased contact area of the beveled coated blade may minimizes or eliminates roller to blade contact at the blade corners (stress concentration area) where the blade is most prone to wear.

In summary, in embodiments a detoning blade is provided including a carbon steel or stainless steel member having a coating disposed thereon. The detoning blade has a length, a width, and a thickness. The coating may include titanium nitride or tungsten carbide of a thickness ranging from 0.1 microns to 4 microns or a coating of diamond embedded chromium coating (Armoloy XADC) of a thickness ranging from 2.5 microns to 7.5 microns on at least a portion of the steel member. The blade may include a free end having a beveled edge forming a non-square corner on the free end of the detoning blade. The blade may include a free end having two square corners on the free end of the detoning blade.

Such detoning blades, systems and methods of use advantageously overcome various limitations and provide generally low development and production costs, and generally high quality blades. The embodiments discussed above refer to a detoning blade and a detoning roller. However, the present invention can also be applied to a cleaning blade and a photoreceptive surface to reduce end wear of the photoreceptive drum or belt.

While this invention has been described in conjunction with various embodiments, it is evident that many alternatives, modifications, and variations thereof will be apparent to those skilled in the art. Accordingly, it is intended to embrace all such alternatives, modifications, and variations and their equivalents.

What is claimed is:

1. A detoning blade comprising:

a steel member comprising at least one of carbon steel grade 1095 and stainless steel, the member having a length, a width, a surface, and a thickness; and a coating comprising tungsten carbide disposed on at least a portion of the surface of the steel member defining a layer;

wherein the coating has a thickness ranging from 0.1 micron to 4 microns.

2. The detoning blade of claim 1, wherein the steel is at least one of carbon steel grade 1095, stainless steel grade 301, and stainless steel grade 302.

3. The detoning blade of claim 2, wherein the coating is tungsten carbide and the surface hardness of the member is up to 68 Rockwell C.

4. The detoning blade of claim 2, wherein the blade further includes a free end having a beveled end forming a non-square.

5. The detoning blade of claim 2, wherein the blade further includes a free end having two square corners.

6. A detoning blade comprising:

a steel member having a length, a width, and a thickness; and a coating comprising diamond embedded chromium on at least a portion of the steel member;

wherein the coating has a thickness ranging from 2.5 microns to 7.5 microns and a surface hardness up to 90 Rockwell C.

7. The detoning blade of claim 6, wherein the steel is at least one of carbon steel grade 1095, stainless steel grade 301, and stainless steel grade 302.

8. The detoning blade of claim 7, wherein the blade includes a free end having a beveled end.

9. The detoning blade of claim 7, wherein the blade includes a free end having two square corners.

10. A method of making a detoning blade comprising:

providing a steel member having a length up to 40 mm and a thickness up to 100 microns; and applying a coating ranging from 0.1 micron to 7.5 microns on at least a portion of a surface of the steel member, the coating including at least one of titanium nitride, tungsten carbide, and diamond embedded chromium.

11. The method of claim 10, further comprising providing a coating having a thickness ranging from 0.1 micron to 4 microns using at least one of titanium nitride and tungsten carbide using at least one of physical vapor deposition and chemical vapor deposition at a temperature ranging from 70 degrees F. to 450 degree F. and deposition pressure ranging from 0.05 torr to 0.15 torr.

12. The method of claim 10, further comprising providing a coating having a thickness ranging from 2.5 micron to 7.5 microns using diamond embedded chromium at a temperature ranging from 70 degrees F. to 200 degree F.

13. The method of claim 10, further comprising beveling the end of the blade at an angle ranging from 30 degrees to 45 degrees relative to the end of length of the blade prior to applying the coating.

14. The method of claim 11, wherein the steel is at least one of carbon steel grade 1095, stainless steel grade 301, and stainless steel grade 302.

15. An apparatus for removing particles from a surface of a roller, comprising:

a housing defining an open ended chamber;

a roller rotatably mounted in said housing;

a detoning blade having a length, a width, a thickness, a free end and a fixed end, the free end being in contact with the roller, the detoning blade comprising a steel and a coating thereon having a thickness ranging from 0.1 micron to 7.5 microns disposed on at least a portion of the steel, the coating including at least one of titanium nitride, tungsten carbide, and diamond embedded chromium; and a detoning blade holder coupled to the housing on one end and coupled to the fixed end of the detoning blade on another end of the detoning blade holder, the free end of said detoning blade contacting the roller.

16. The apparatus of claim 15 wherein said detoning blade has a beveled edge in contact with the roller.

17. The apparatus of claim 16, wherein the steel is at least one of carbon steel grade 1095, stainless steel grade 301, and stainless steel grade 302.

18. The apparatus of claim 15, wherein the roller is a ceramic detoning roller.

19. A method for removing particles from a surface of a roller, comprising:

providing a roller having a surface;

providing a detoning blade having a length, a width, a thickness, and a free end in contact with the roller, the detoning blade comprising a steel and a coating having a thickness ranging from 0.1 micron to 7.5 microns disposed on at least a portion of the member, the coating including at least one of titanium nitride, tungsten carbide, and diamond embedded chromium;

supporting the detoning blade in a detoning blade holder;

applying a force on the roller using the free end of the detoning blade; and rotating the roller and scraping toner from the surface.

20. The method of claim 19, further comprising providing a detoning blade made of a steel of at least one of carbon steel grade 1095, stainless steel grade 301, and stainless steel grade 302.

21. The method of claim 20, further comprising providing a beveled edge at the free end of the detoning blade said detoning blade has a beveled edge in contact with the roller.

22. The method of claim 21, further comprising providing a ceramic detoning roller.

* * * * *